United States Patent [19]

Fleming

[11] 4,441,203

[45] Apr. 3, 1984

[54] MUSIC SPEECH FILTER

[76] Inventor: Mark C. Fleming, 145 S. 7th St., Zanesville, Ohio 43701

[21] Appl. No.: 260,007

[22] Filed: Mar. 4, 1982

[51] Int. Cl.[3] ..... G10L 1/04

[52] U.S. Cl. ..... 381/110; 381/46

[58] Field of Search ..... 179/1 F, 1 J, 1 VC, 179/1 VL, 1 SC, 1 P; 455/228; 381/41, 46, 49, 61, 94, 104, 107, 108, 110

[56] References Cited

U.S. PATENT DOCUMENTS

| | | | |
|---|---|---|---|
| 2,424,216 | 7/1947 | Atkins | 179/1 VC |
| 2,761,897 | 9/1956 | Jones | 179/1 VC |
| 3,668,322 | 6/1972 | Allen et al. | 179/1 VC |
| 3,873,926 | 3/1975 | Wright | 179/1 VC X |
| 4,314,100 | 2/1982 | Ruether et al. | 179/1 VC X |

OTHER PUBLICATIONS

Gannett, E. K., *Radio Attachment Eliminates Commercials;* Institute of Radio Engineers, N.Y., 3/22/51, presented at Radio Engineers Convention.

*Radio Electronics;* vol. 27, No. 9, Sept. 1956, pp. 62–64; "Speech-Music Discriminator," by Edward Predmore.

*Electronics,* Apr. 1957, pp. 183–185; "Music Pulse Analyzer Rejects Voice Signals," by Ronald L. Ives.

*Primary Examiner*—A. D. Pellinen

*Assistant Examiner*—Keith E. George

[57] ABSTRACT

A music/speech filter is provided for automatically determining whether an audio signal is music or speech by obtaining a relative measure of the energy in a selective frequency range and, from this determination, controlling the passage or path of the audio signal. The filter can be attached to a radio receiver to selectively pass either music or speech at the option of the user.

5 Claims, 3 Drawing Figures

MUSIC SPEECH FILTER

BACKGROUND OF THE INVENTION

This invention performs an analysis of audio signals on the basis of the differences in energy distribution of speech versus music over substantial time intervals and controls unpredictable sequences of periods of music and periods of speech. Relevant prior art in the area of speech analysis occur in inventions such as that of John D. Williamson U.S. Pat. No. 4,142,067. Invention 4,142,067 does not address itself to the analysis and control of unpredictable sequences of periods of music and periods of speech.

The following patents are listed as references forming pertinent reference material of record relevant to the area of automatic speech—music discrimination. Along with other differences, none of the following inventions utilize a magnetic tape delay or multiple cycled integrators, the latter being an integral part of this invention and which the applicant believes represents improvement in the state of the art.

(1) U.S. Pat. No. 4,314,300 by Peter G. Ruether, et. al—Data Detection Circuit for a TASI System.
(2) U.S. Pat. No. 3,873,926 by Larry R. Wright—Audio Frequency Squelch System.
(3) U.S. Pat. No. 3,668,322 by Richard G. Allen, et. al.—Dynamic Presence Equalizer.
(4) U.S. Pat. No. 2,761,897 by Robert Clark Jones, et. al.—Electronic Device for Automatically Descriminating between Speech and Music.
(5) U.S. Pat. No. 2,424,216 by Carl Edward Atkins—Control System for Radio Receivers.

SUMMARY OF THE INVENTION

This invention electronically and automatically determines whether an audio signal is music or speech and controls the path of the audio signal based on the determination. The filter presorts the audio signal by passing audio frequencies above 800 Hz and then obtains a relative measure, over substantial multisecond intervals, of the energy contained in the presorted audio signal. Energy measures that are above an experientially determined adjustable reference level are classified by the filter as being representative of music and those below this level are classified by the filter as being representative of speech. The audio signal input to the filter is delayed so that it will arrive at the point of control at the same time as the control signal from the energy measurement circuitry. Due to the substantial delay used in the energy measurement, a lag error, which begins at the transistion of the audio signal from music to speech or from speech to music, is reduced by providing a multiplicity of energy measurements and these are equally spaced throughout the interval used for a single measurement of energy.

Human speech is composed of a "buzz" component and a "hiss" component. The buzz component, resulting from the passage of air from the lungs over the vocal cords, has a fundamental frequency between 80 Hz and 240 Hz. The hiss component resulting from articulation by the tongue and the effect of various resonant cavities, occurs over a broad range of frequencies extending to well above 5 KHz. Due to the method of generating these components of human speech, much of the energy contained therein occurs below 800 Hz. Music produced by some musical instruments such as chimes and flute have much of their energy content above 800 Hz and other musical instruments such as the guitar and horns have substantial energy components contained in harmonics above 800 Hz.

The filter provides a music/speech determination of audio signals and does this, in part, by first limiting the audio to be further analyzed to frequencies above 800 Hz by means of an RC filter associated with a preamplifier.

A noticeable difference between a multiple second analysis of music and a multiple second analysis of speech is the high probability of a pause in speech and, a low probability of a pause in music. Speech is characterized by pauses which correspond to the grammatical symbols of commas, periods, colons, etcetera. For example, in giving voice to this sentence, most would pause briefly where the commas indicate. In contrast, the pauses in music occur infrequently and are often of the "poetic lull" variety which, being somewhat constrained by the tempo of the music, are often brief. Thus, the energy content of a multiple second period of music is usually larger than that of speech. This invention takes advantage of this difference by measuring the energy content of the audio signal over a substantial multisecond period.

The presorted audio signal is truncated at approximately zero volts by a diode rectifier and the resulting pulsating dc is integrated for several seconds. The output of the integrator is compared to an adjustable reference level. If the "ramp" from the integrator excedes the experientially set reference, the audio signal has a high energy content and is classified as music by the filter. If the "ramp" from the integrator does not excede the reference level, the audio signal has a low energy content and is classified as speech by the filter.

Any measurement of the energy in an unpredictable audio signal requires a time interval. In this invention the time interval is purposely substantial (several seconds) and is a result of the selected long period of integration. The measurement of the energy content of the audio signal and thus the determination of whether the audio signal is music or speech is not available for the control of the path of the input audio signal until several seconds have elapsed after the audio signal enters the filter. A time delay, which could be of the digital bucket brigade type or other type and still be within the scope of this invention, is placed in the path of the audio signal so that the audio to be controlled is available at the time the measurement is available. The time delay used here is of the magnetic tape delay loop type. The time delay used to analyse the input audio signal equals the time delay of the magnetic tape delay. So, the signal to be controlled arrives at the control point simultaneously with the control signal from the energy measuring circuitry.

Also, because of the substantial time (several seconds) used to obtain a correct recognition of the audio signal as music or speech, the filter is subject to error at the transition of the audio signal from music to speech or from speech to music. To reduce this error, the filter uses 5 cycling integrators. That is, the start of the integrating period of the 5 integrators are equally spaced through the time interval set for an integration period of one integrator. Thus, a measure of energy in an integration period becomes available 5 times in an integration period. Though a longer or shorter time for energy measurement could be used and though more than or less than 5 integrators could be used and though single or multiple integrators could be used, the result would be within the scope of this invention. The results of the 5 energy measurements are stored in repetatively updated flip-flops and a weighted sum of these 5 measures is obtained to yield a control signal which permits or inhibits the passage of the delayed audio signal to the output of the filter.

It is an object of this invention that it be attachable to an AM or FM radio receiver enabling the user to control what he hears by inhibiting speech and that which is not music and passing only music this being selectable by the user by way of a switch.

It is another object of this invention that it be attachable to an AM or FM radio receiver enabling the user to control what he hears by inhibiting music and passing speech or all that is not music this being selectable by the user by way of a switch.

It is another object of this invention to permit the sorting of music versus speech from any audio signal sources which might contain either music or speech (but not both simultaneously) and/or to control the path of an audio signal.

DETAILED DESCRIPTION OF THE PREFERED EMBODIMENT

Figure 1:
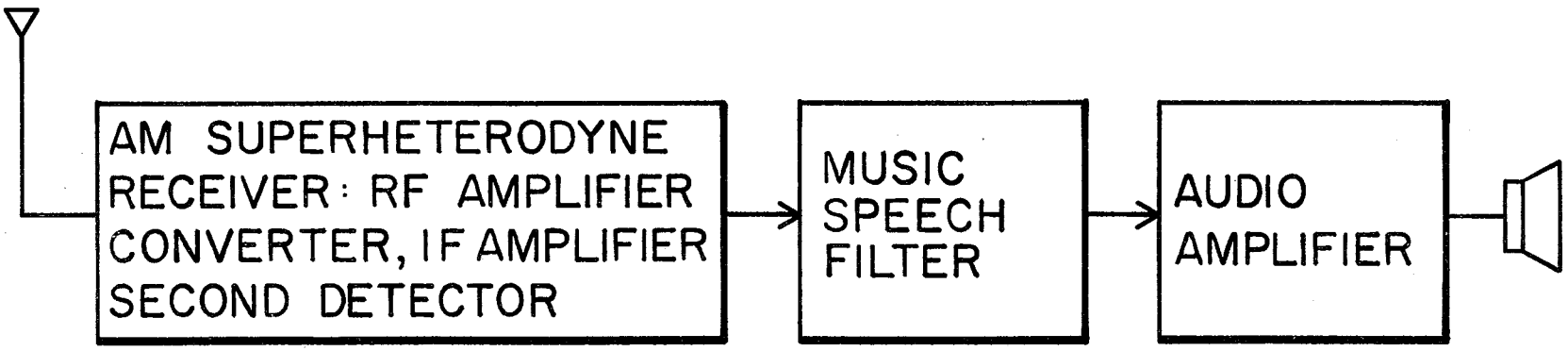
FIG. 1 is a block diagram showing an application of the filter in conjunction with an AM radio receiver.

FIG. 1 illustrates an application of the filter wherein the filter is located in the path of the audio signal in an AM radio receiver between the output of the second detector and the input to the audio amplifier. The filter sorts the music, speech, music, speech, music, speech sequence and passes the sequence music, , music, , music, , or passes the sequence , speech, , speech, , speech. Each of these output sequences is selectable by switch 28 shown in FIG. 2.

Figure 2:
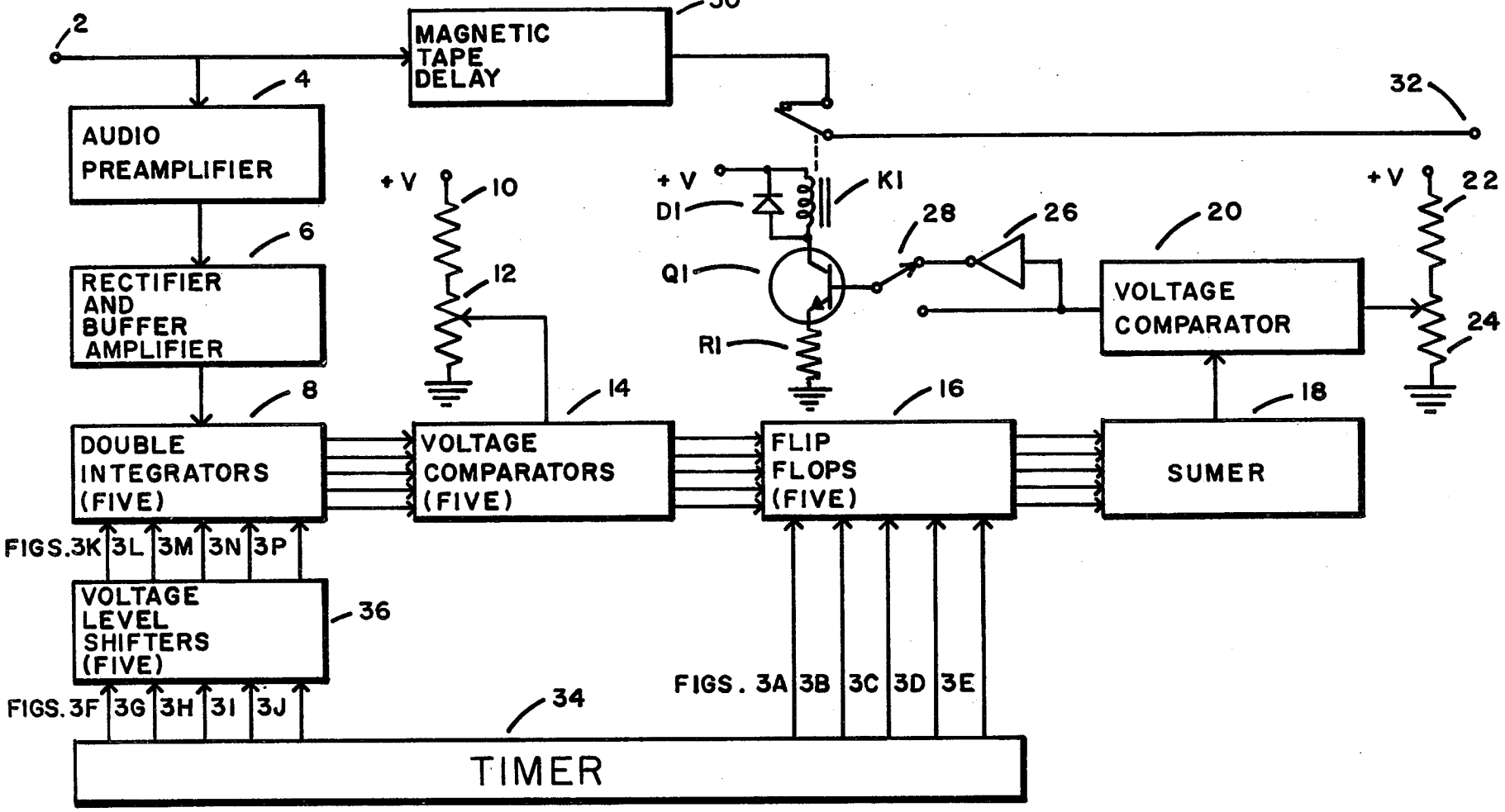
FIG. 2 is a diagram of one embodiment of the filter which shows signal flow paths and the circuit types which operate within the filter.
Figures 3A, 3B, 3C, 3D, 3E, 3F, 3G, 3H, 3I, 3J, 3K, 3L, 3M, 3N, 3P:
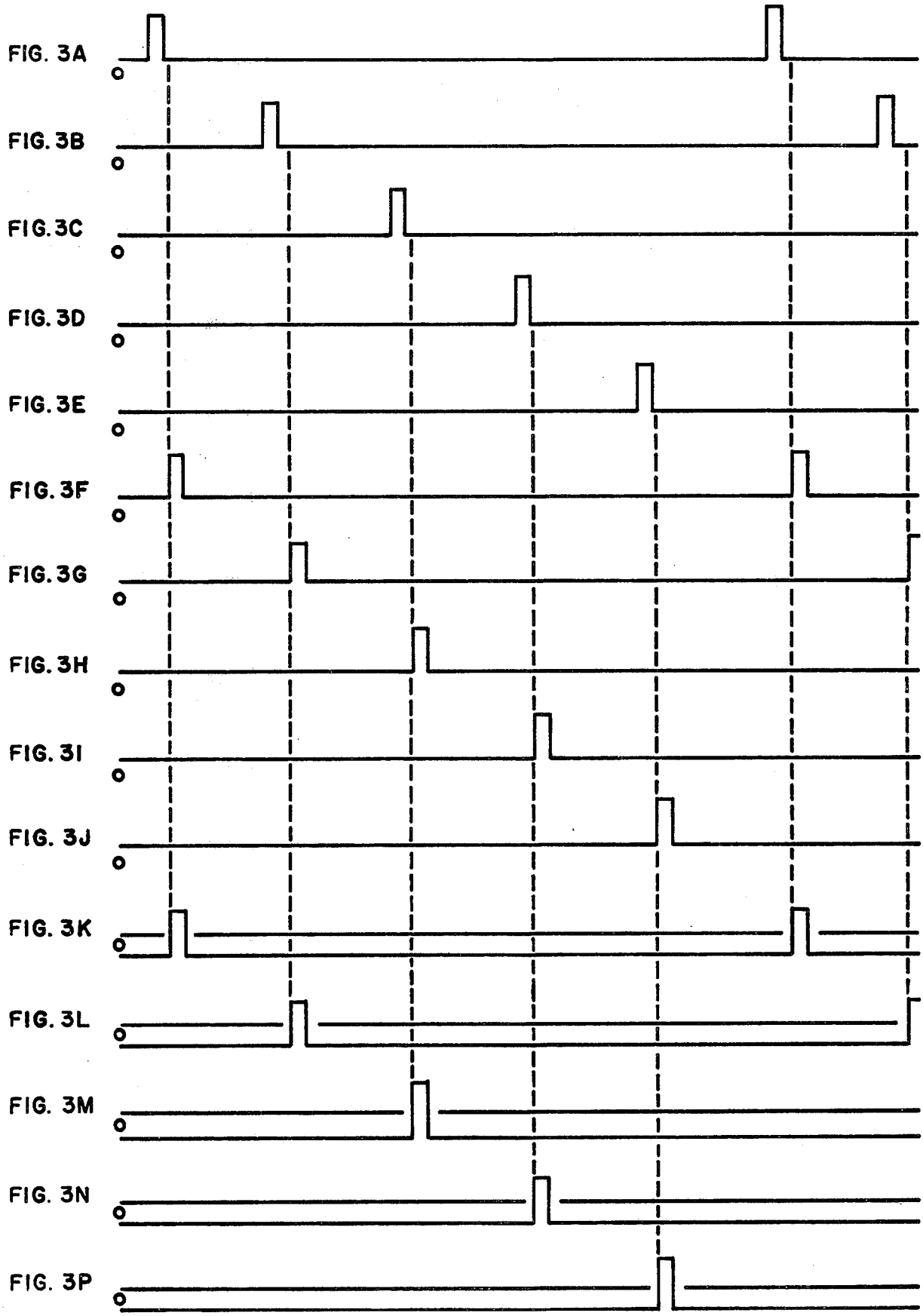
FIGS. 3A–3P illustrate the electrical signals and relative timing of pulses generated within the filter.

Referring to FIG. 2 and pulse diagrams, FIGS. 3A–3P, the audio signal is introduced into the filter at 2 in FIG. 2. This audio input signal is presented to a magnetic tape delay and is also amplified by the preamplifier, 4. The preamplifier has a voltage gain, $A_v$, that is relatively uniform between the frequencies of 800 Hz and 5 KHz at which frequencies the voltage gain is half of $A_v$. Full-bodied music often has much energy in this frequency range whereas much of the energy in speech occurs below 800 Hz. The preamplifier has a tendency, then, to provide an output signal which is higher in energy content for music input signals than for speech input signals. The preamplified audio signal is rectified by a diode rectifier in 6 and the resulting pulsating dc is buffered by a buffer amplifier in 6. The pulsating dc from the buffer amplifier in 6 is presented to all 5 inputs of the 5 double integrators in 8. Each of the 5 double integrators provide an output, $e_o$, which is related to the pulsating dc input, $e_i$, by $$e_o = k \int_o^7 \int_o^7 e_i \, dt \, dt$$

The output, $e_o$, of each double integrator is a ramp of 7 second duration which has a variable rate of rise. Each of the 5 ramps is presented to a voltage comparator in 14 where it is compared to a single, adjustable, dc reference voltage derived from the voltage divider consisting of resistor 10 and potentiometer 12. The output of each voltage comparator, either a logical 0 or a logical 1, is a discrete representation of the energy content of the input audio signal at 2. The logical 1 condition occurs when the input audio signal has a high energy content. Music which is continuous and of full body often generates a logical 1 at the output of a comparator within the seven second interval for a given, experientially determined, setting of potentiometer 12. In contrast, speech is typified by frequent pauses such as occur at the grammatical points of periods, commas, colons, etcetera, and this results in lower energy content when measured over a substantial interval such as 7 seconds. This lower energy level characteristic of speech often results in a logical 0 at the output of each comparator in 14. Each of the binary outputs from the 5 voltage comparators in 14 is gated into a flip-flop in 16 by a read pulse. FIGS. 3A–3E, from the timer, 34.

The timer, 34, repetatively produces ten narrow pulses whose pulse width is approximately 50 milliseconds in a fixed sequence illustrated in FIGS. 3A–3J. Of these, there are 5 pulses, 3F–3J, feeding the voltage level shifters in 36 which, in turn, produce the five pulses, 3K–3P, which are used to discharge the double integrators in 8. These pulses into 8, FIGS. 3K–3P, fix the instant each double integrator starts its 7 second integrating period and, since these pulses are repetative and staggered, with 1.4 seconds elapsing between any and the next succeeding discharge pulse, the 5 double integrators in 8 are cycled double integrators.

The 5 read pulses, FIGS. 3A–3E, from timer, 34, are repetative and staggered with 1.4 seconds elapsing between any and the next succeeding read pulse. These read pulses gate the binary representation of the energy measurement from 14 into the flip-flops in 16. Thus, the 5 flip-flops in 16 are cycled flip-flops.

As shown in FIGS. 3A–3J, each read pulse is closely followed by a discharge pulse. For example, read pulse FIG. 3A is followed by discharge pulse 3F. There are 5 such pairs of pulses in each cycle of the timer. Thus, the occurance of a read pulse which gates a discrete binary measure of energy from a voltage comparator in 14 into a flip-flop in 16, is followed by a discharge pulse which, after being level shifted in 36, discharges the corresponding double integrator which produced the measured voltage.

The outputs from the 5 flip-flops in 16 are presented to a sumer, 18, whose output is a fifth of the sum of the sumer's input voltages. This sum is presented to a voltage comparator, 20, and thus compared to the adjustable dc reference voltage derived from the voltage divider consisting of resistor 22 and potentiometer 24. By adjusting potentiometer 24, the number of logical 1 states from the 5 flip-flops can be selected which in turn will control the passage of the audio signal from the magnetic tape delay to the output, 32.

The output of the voltage comparator, 20, is inverted by the inverting amplifier, 26, and both the inverted and the noninverted voltage form from the voltage comparator are thus selectable by switch 28. That output control voltage selected by switch 28 is used to produce one of the two controlled output patterns at 32 illustrated in the first paragraph of this detailed description;

the music—silence sequence or the speech—silence sequence. The output selected by switch 28 is used to control the base current of transistor Q1. This base current controls the current through the coil of relay K1 with resistor R1 limiting the maximum amount of collector current flowing through the coil of K1. The diode, D1, serves to protect the transistor, Q1, from the high voltage produced by K1 when the transistor is quickly turned off. During the operation of the filter, the contacts of relay K1 are either closed, permitting the passage of the 7 second delayed audio signal from the magnetic tape delay, 30, to the output, 32, or the contacts are open, inhibiting the output of the magnetic tape delay from arriving at the output, 32.

The continuous magnetic tape delay provides a time delay of 7 seconds in the path of the audio signal. This time interval equals the delay occuring in the measurement of the energy by the double integrators. An illusary result is that the filter appears to the user to operate in real time.

This invention can be embodied in other specific forms but remain within the essential spirit of this invention. The prefered embodiment described herein is to be thought of as but a single view of a wider set of embodiments with the restrictions on the wider set tailored by the following claims rather than the detailed description of the prefered embodiment appearing herein and all variations which will fit the spirit of the outline of the claims are to be included within the claims. For example, the period of integration stated in this prefered embodiment could be more or less and still be within the scope of this invention.

I claim:

1. An automatic programmable Music/Speech filter, having an input and an output, which identifies electrical signals applied to said input as representing either music or speech and selectively passes to said output only music signals or only speech signals comprising:

(a) preamplifier means for amplifying and filtering signals applied to said input, wherein the frequency response of said preamplifier means is such that signals corresponding in frequency to most speech energy are inhibited and signals corresponding in frequency to much music energy are amplified providing amplified audio signals;

(b) rectifier means which rectify said amplified audio signals thus providing pulsating DC signals;

(c) integrator means for integrating said pulsating DC signals, said integrator means comprising two or more cycled integrators;

(d) two or more adjustable comparators which compare the outputs of the cycled integrators to an adjustable reference;

(e) means for storing digital output signals from said comparators;

(f) sumer means which sums the digital signals stored by said means for storing;

(g) a timer which generates sequences of pulses to cycle operation of the integrators and operation of the means for storing;

(h) a signal level comparator which compares the output of the sumer with an adjustable reference and provides a digital control signal identifying the signals applied to said input as representing either music or speech;

(i) means for delaying signals applied to said input;

(j) an audio control circuit responsive to said digital control signal to selectively apply delayed audio signals output by the delaying means to the output of the Music/Speech filter; and (k) switch means for setting operation of said audio control circuit such that it applies the delayed audio signals to said output exclusively when they have been identified as music or exclusively when they have been identified as speech.

2. An automatic, programmable Music/Speech filter as specified in claim 1 wherein:

the two or more adjustable comparators comprise voltage comparators;

the means for storing comprise two or more flip-flops;

the signal level comparator comprises a voltage comparator;

the means for delaying comprises a magnetic tape delay; and the audio control circuit comprises a transistor controled relay.

3. An automatic, programmable, Music/Speech filter as stated in claim 1 wherein such filter is attachable to an AM or FM radio receiver enabling automatic control of what is heard by inhibiting speech and that which is not music and passing only music, this being selectable by a user by way of the switch means.

4. An automatic, programmable, Music/Speech filter as stated in claim 1 wherein such filter is attachable to an AM or FM radio receiver enabling automatic control of what is heard by inhibiting music and passing speech or all that is not music this being selectable by a user by way of the switch means.

5. An automatic, programmable, Music/Speech filter as stated in claim 1 wherein the Music/Speech filter sorts music and speech signals from any source of audio signals which might contain either music or speech, but not both simultaneously, and controls the path of said audio signals.

* * * * *